US007823333B2

(12) United States Patent
Kim

(10) Patent No.: US 7,823,333 B2
(45) Date of Patent: Nov. 2, 2010

(54) STRUCTURE FOR CONNECTING PREFABRICATED ARCHITECTURAL PANELS

(76) Inventor: Young Mi Kim, 408-701 Hyundai Apartment, Seohyun-Dong Bundang-Gu, Gyeonggi-do, Seongnam-si (KR) 463-050

( * ) Notice: Subject to any disclaimer, the term of this patent is extended or adjusted under 35 U.S.C. 154(b) by 1267 days.

(21) Appl. No.: 10/510,472

(22) PCT Filed: Apr. 11, 2003

(86) PCT No.: PCT/KR03/00725

§ 371 (c)(1),
(2), (4) Date: Oct. 7, 2004

(87) PCT Pub. No.: WO03/089734

PCT Pub. Date: Oct. 30, 2003

(65) Prior Publication Data

US 2005/0160691 A1 Jul. 28, 2005

(30) Foreign Application Priority Data

Apr. 13, 2002 (KR) ..... 10-2002-0020265
Dec. 31, 2002 (KR) ..... 20-2002-0039334 U

(51) Int. Cl.
*E04B 2/74* (2006.01)

(52) U.S. Cl. ..... 52/36.5; 52/589.1; 52/592.6

(58) Field of Classification Search ..... 52/36.5, 52/36.6, 518, 589.1, 592.1, 592.6, 177, 483.1, 52/284, 287.1; 211/94.01, 189, 87.01, 59.1; D25/122, 123

See application file for complete search history.

(56) References Cited

U.S. PATENT DOCUMENTS

| | | | | |
|---|---|---|---|---|
| 1,980,347 | A | 11/1934 | Miller et al. | 189/85 |
| 2,072,386 | A * | 3/1937 | Smallwood | 52/281 |
| 3,420,028 | A * | 1/1969 | Barker | 52/588.1 |
| 4,127,974 | A * | 12/1978 | Wendt | 52/287.1 |
| 4,450,970 | A * | 5/1984 | Shepherd | 211/189 |

(Continued)

FOREIGN PATENT DOCUMENTS

EP 0333519 A1 9/1989

(Continued)

*Primary Examiner*—Jeanette E Chapman
*Assistant Examiner*—Daniel Kenny
(74) *Attorney, Agent, or Firm*—Seed IP Law Group PLLC

(57) ABSTRACT

A structure for easily connecting prefabricated panels, which are attached to outer and inner walls of buildings, is disclosed. The structure includes inner prefabricated panels (10), each of which has a recess (11) and a rib (12) at its upper end and has an inner rib (13) bent downward to be engaged in a recess of a lower adjacent panel; corner finishing members (20) provided at a corner between adjacent panels, and each of which has opposite wing portions (21); inner ribs (22) protruded inwardly and having claw portions (23) respectively; outer prefabricating panels (10-2) attached onto the inner prefabricated panels (10); connecting members interposed between the adjacent outer panels (10-2) to attach the outer panel (10-2) to the inner panel (10); side finishing members (40) provided at sides of the inner panels (10), upper finishing members (40) provided at sides of the inner panels (10), upper finishing members (40) provided at uppermost inner panel; and lower finishing member (60) provided at uppermost inner panel; and lower finishing member (60) provided at an lowermost inner panel.

9 Claims, 16 Drawing Sheets

U.S. PATENT DOCUMENTS

| | | | | | |
|---|---|---|---|---|---|
| 4,531,331 | A | * | 7/1985 | Itagaki | 52/38 |
| 4,689,930 | A | * | 9/1987 | Menchetti | 52/277 |
| 5,398,468 | A | * | 3/1995 | Erickson | 52/282.3 |
| 5,941,026 | A | * | 8/1999 | Eisenreich et al. | 52/36.5 |

FOREIGN PATENT DOCUMENTS

| | | | |
|---|---|---|---|
| FR | 925 679 | | 9/1947 |
| FR | 2544000 | A1 | 10/1984 |
| FR | 2595225 | A1 | 9/1987 |
| FR | 2 636 654 | | 3/1990 |
| FR | 2697274 | A1 | 4/1994 |
| GB | 2 015 068 | A | 9/1979 |
| JP | 03-059259 | | 3/1991 |
| JP | 06-002409 | | 1/1994 |
| JP | 06-042138 | | 2/1994 |
| JP | 07-180324 | | 7/1995 |
| KR | 0134667 | U | 2/1999 |
| WO | 9533110 | A1 | 12/1995 |

* cited by examiner

【Fig 1】
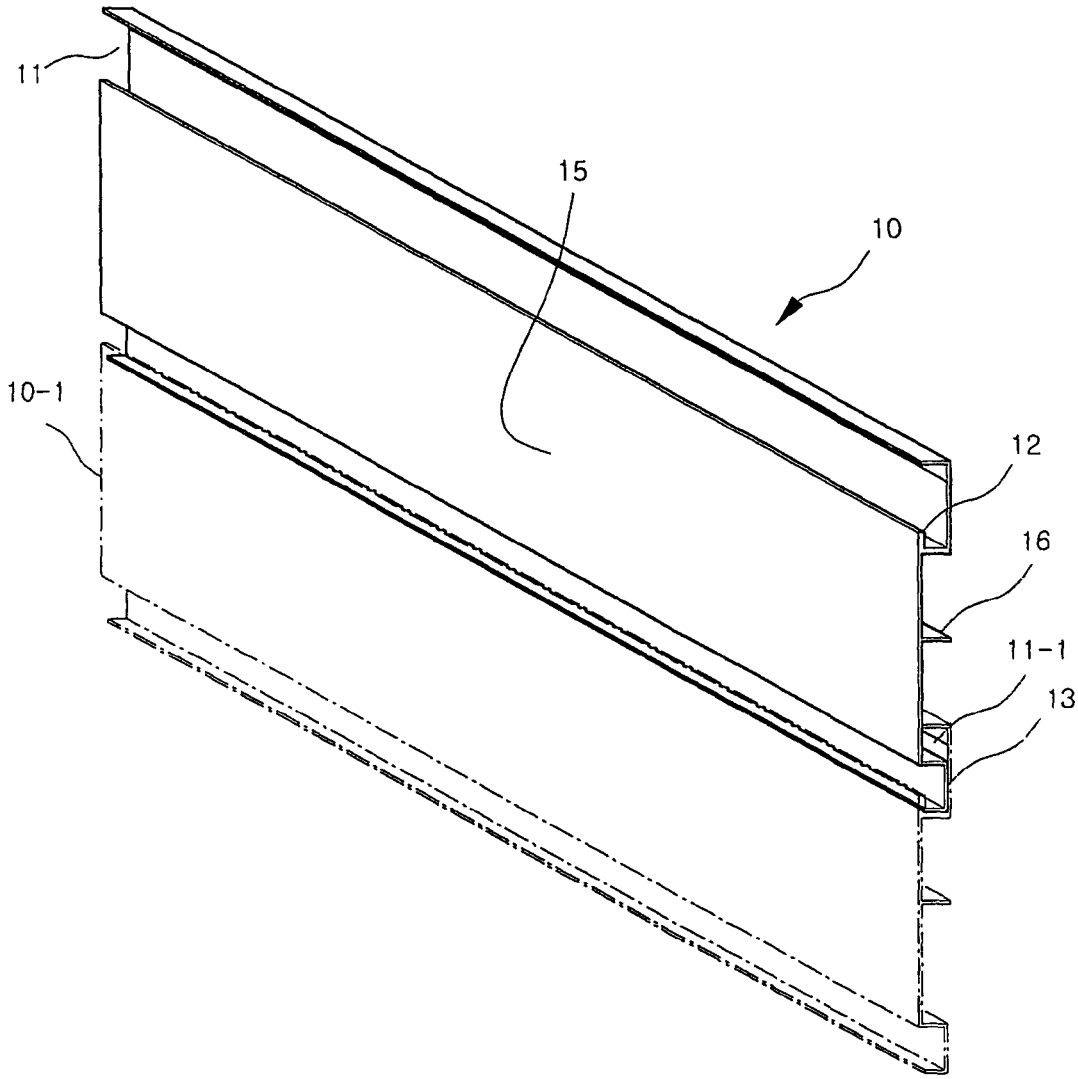

【Fig 2】
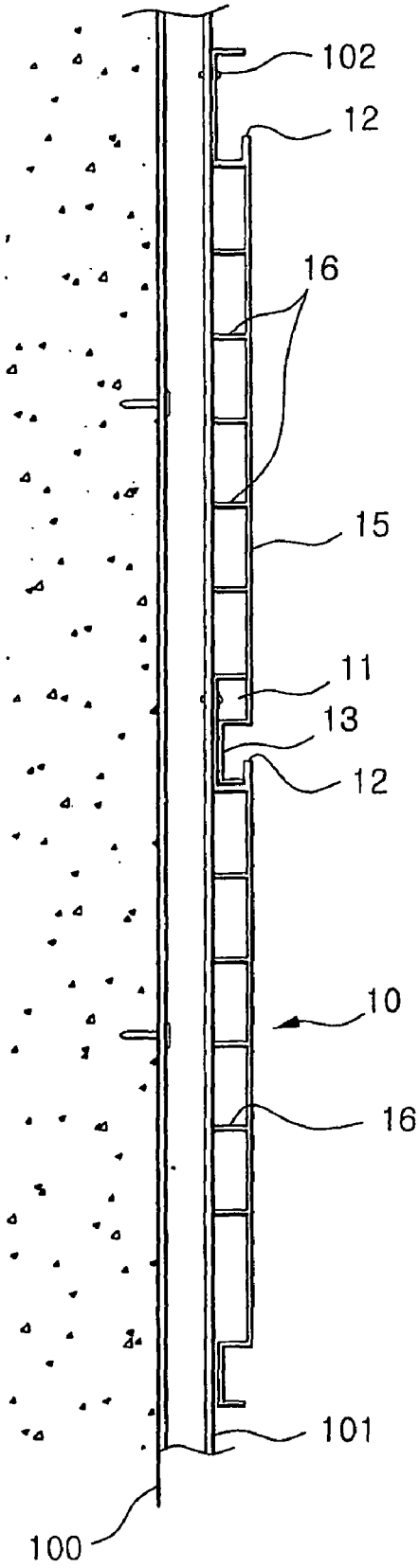

【Fig 3】
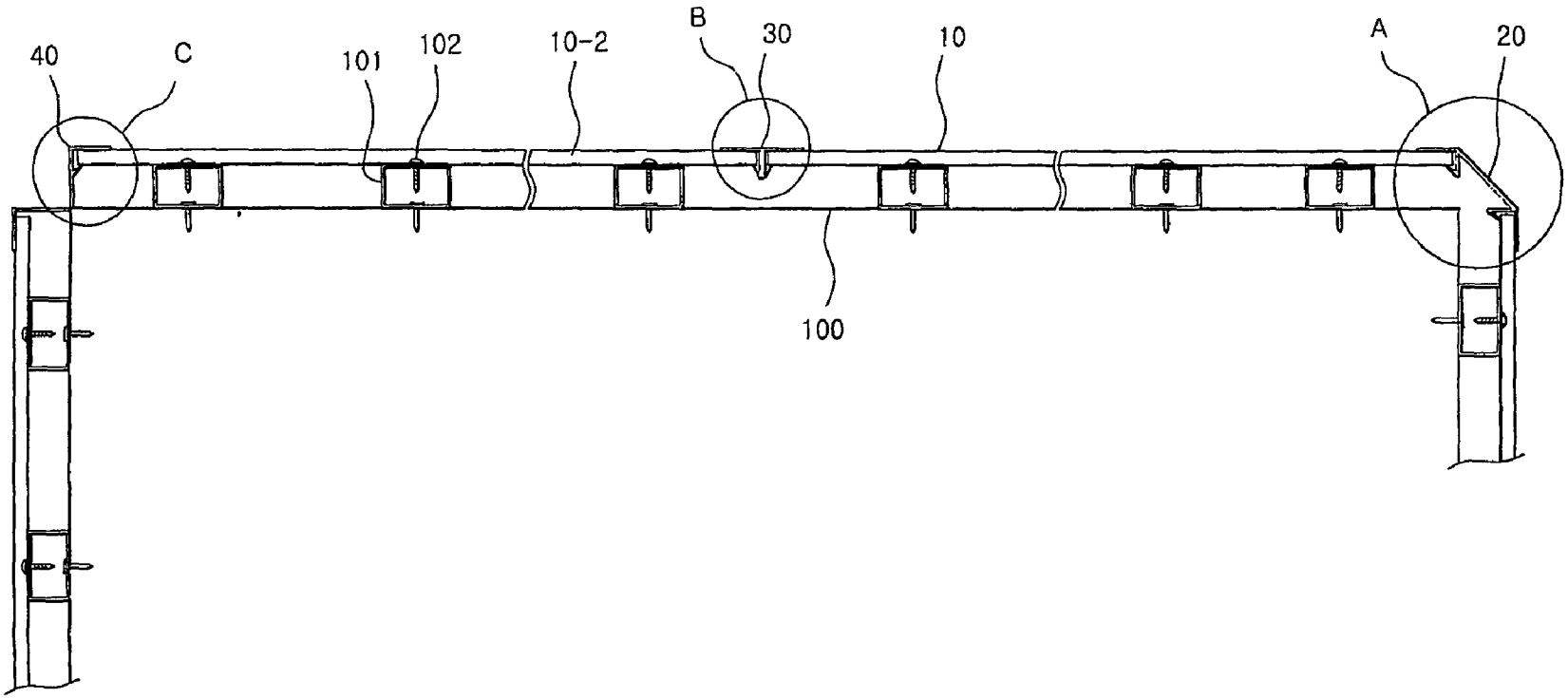

【Fig 4】
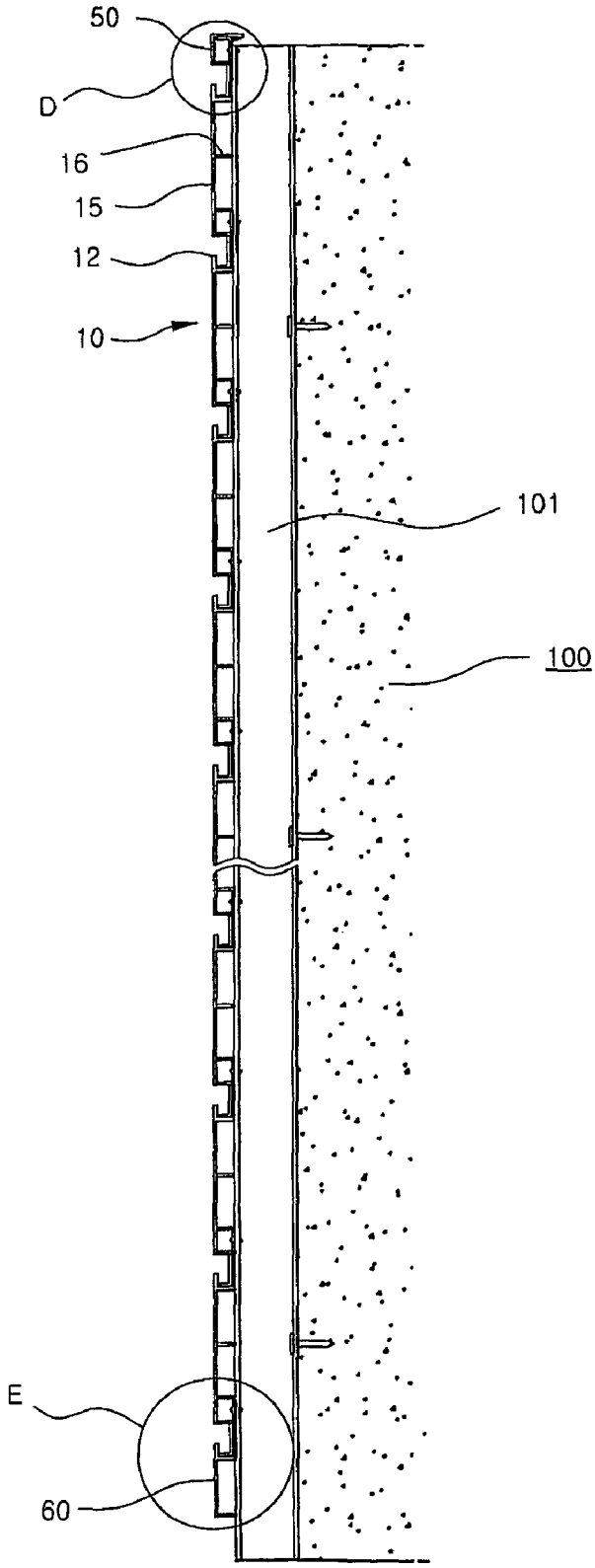

【Fig 5a】
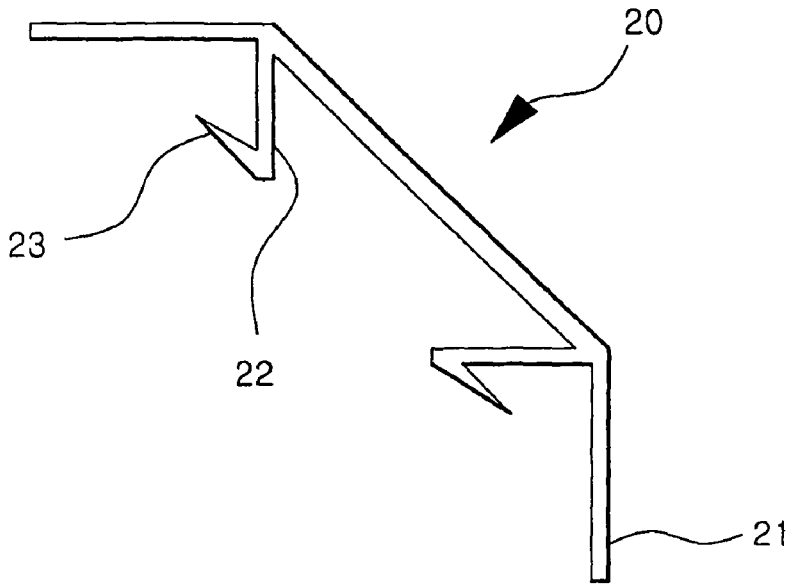
【Fig 5b】
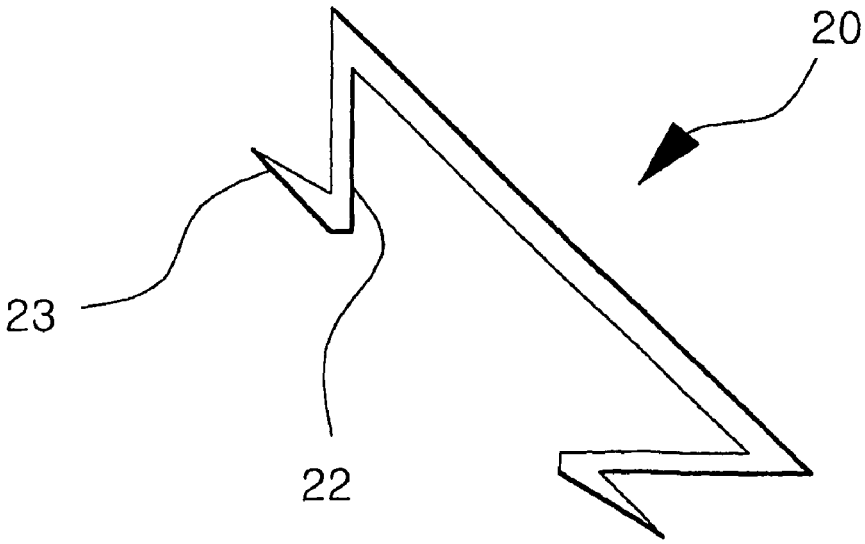

【Fig 6】
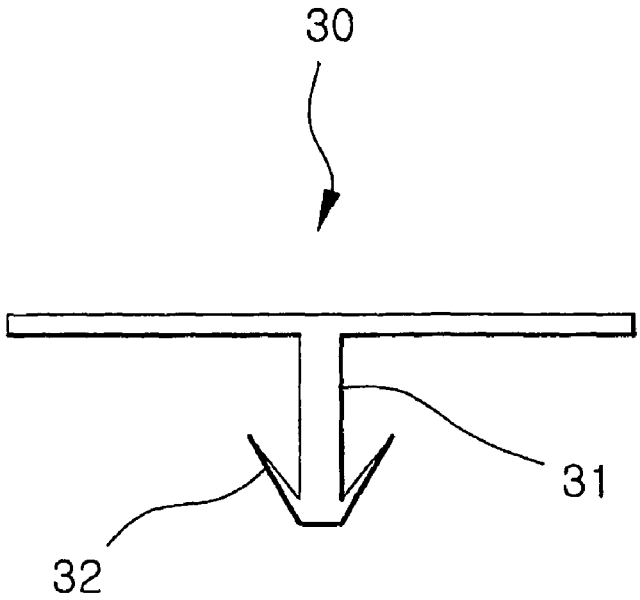
【Fig 7】
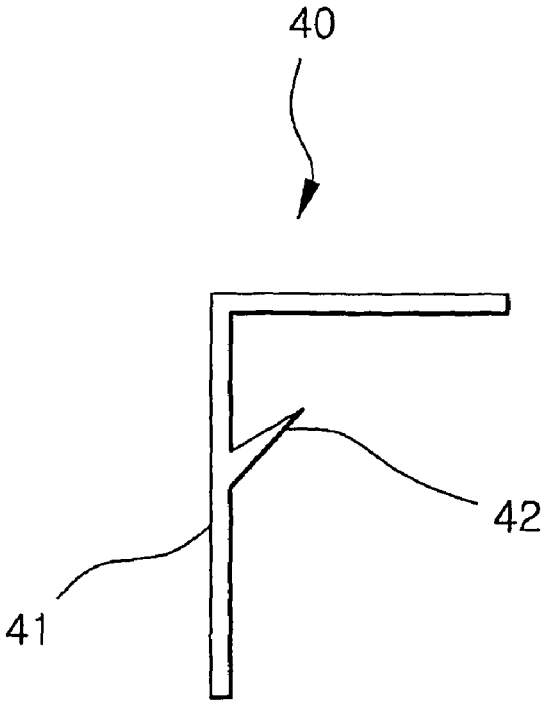

【Fig 8】
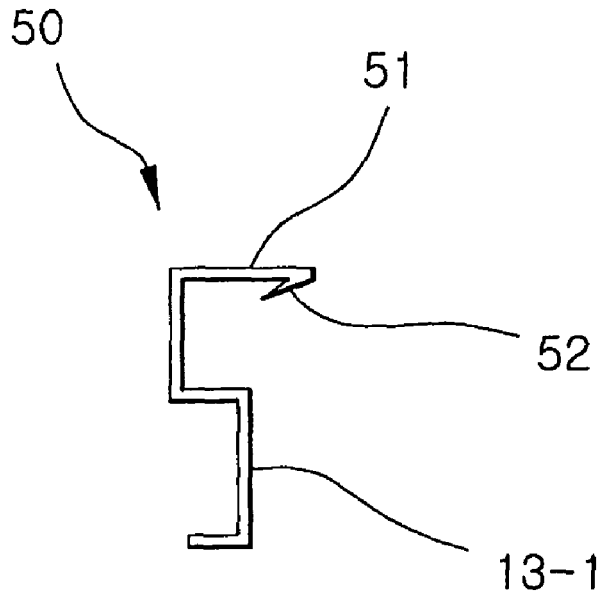
【Fig 9】
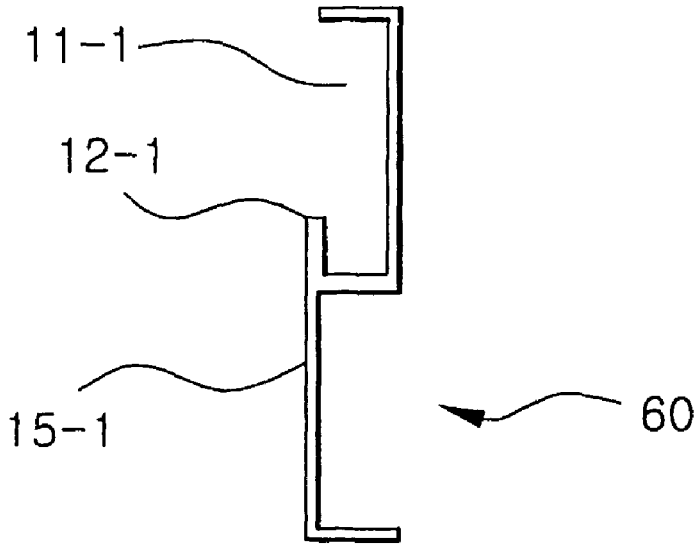

【Fig 10a】
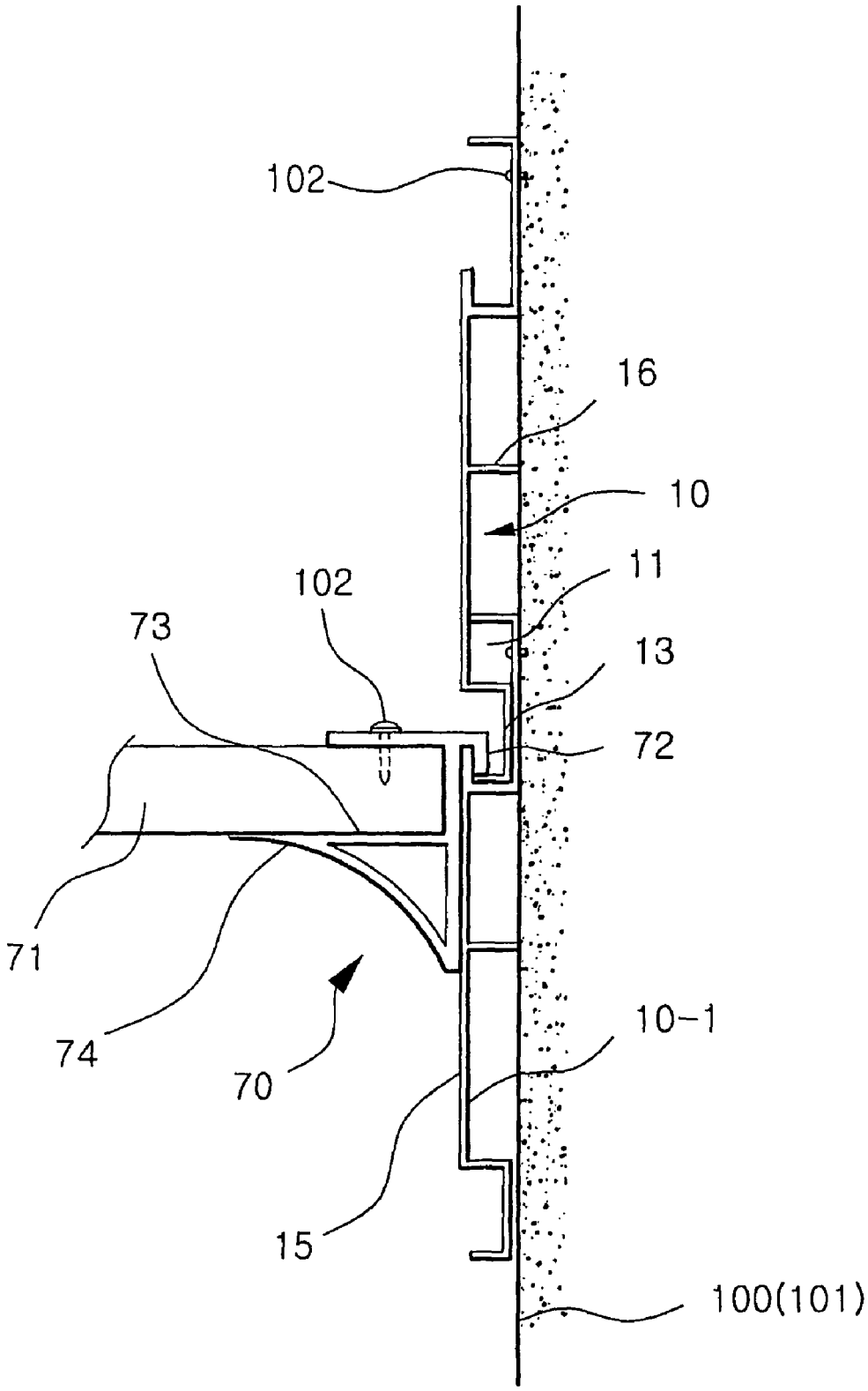

【Fig 10b】
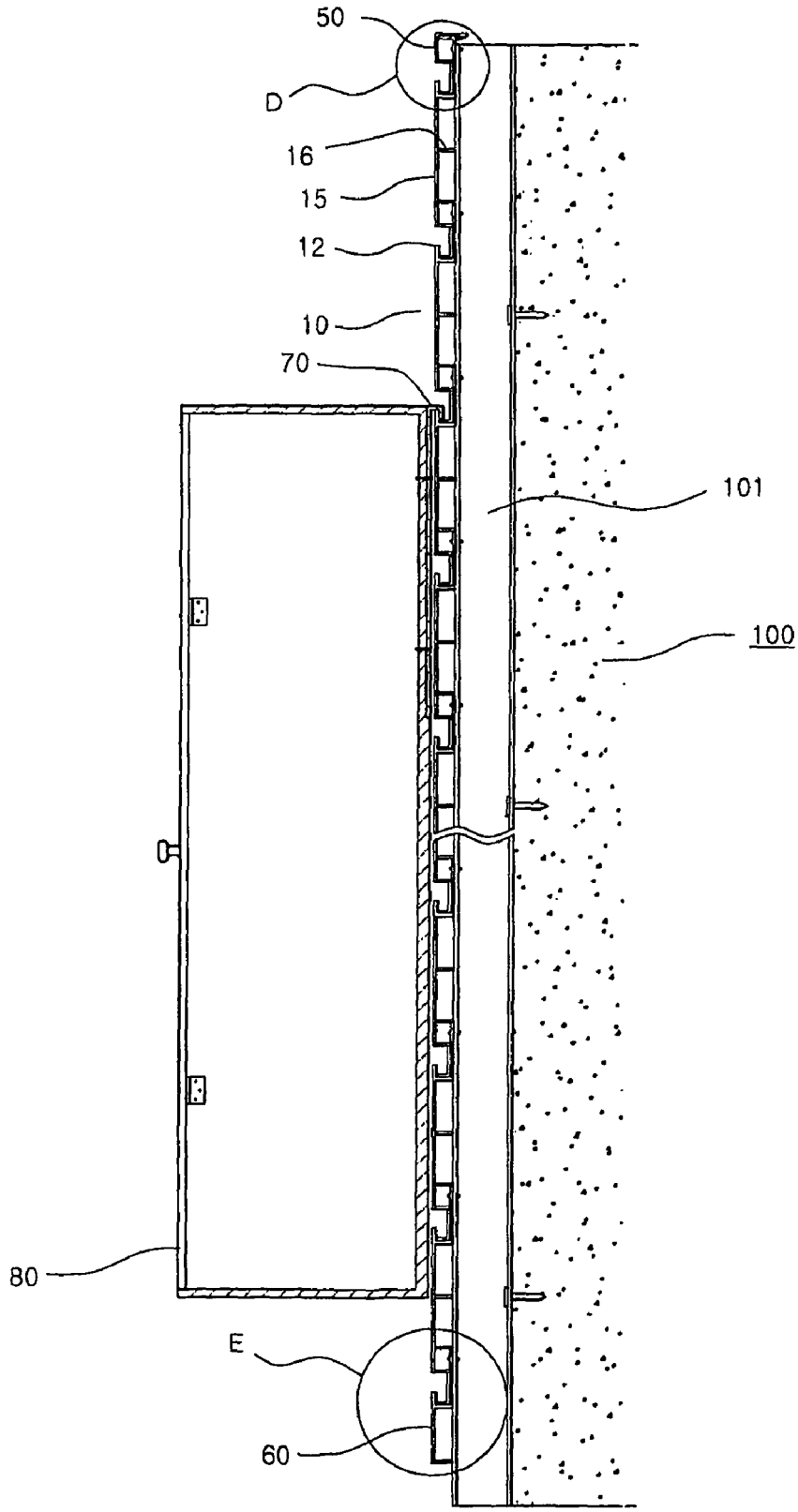

【Fig 11】
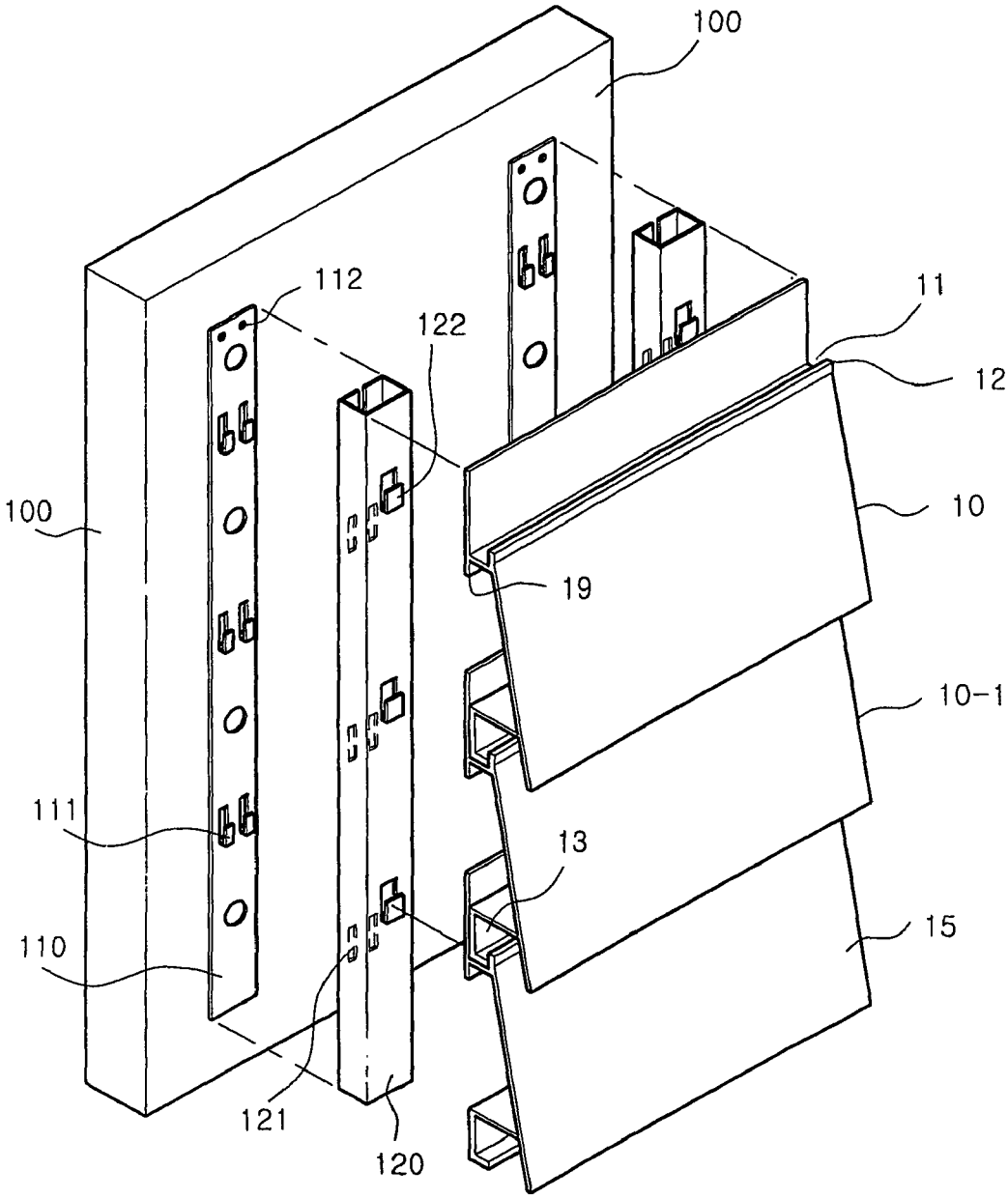

【Fig 12】
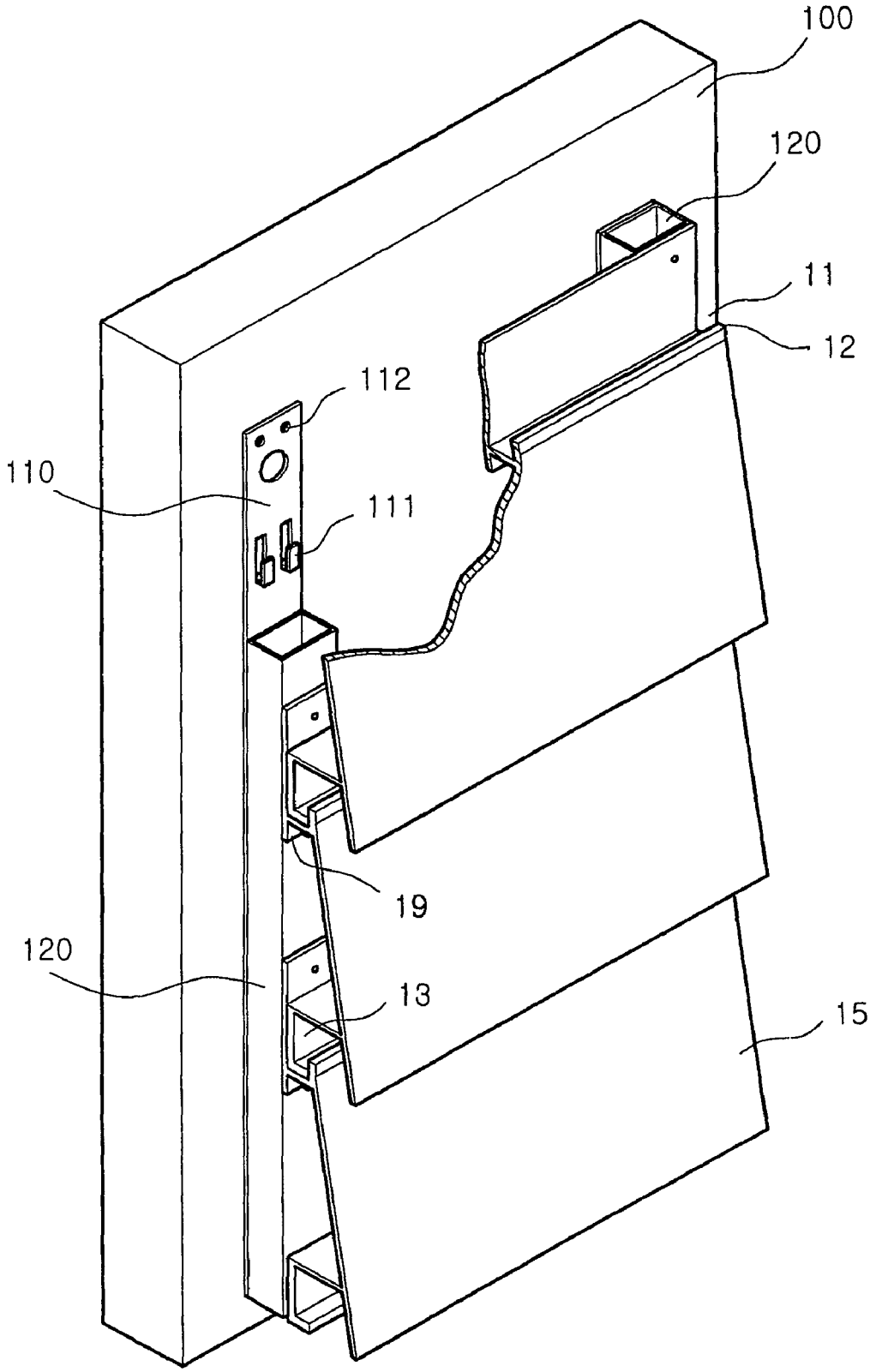

【Fig 13a】
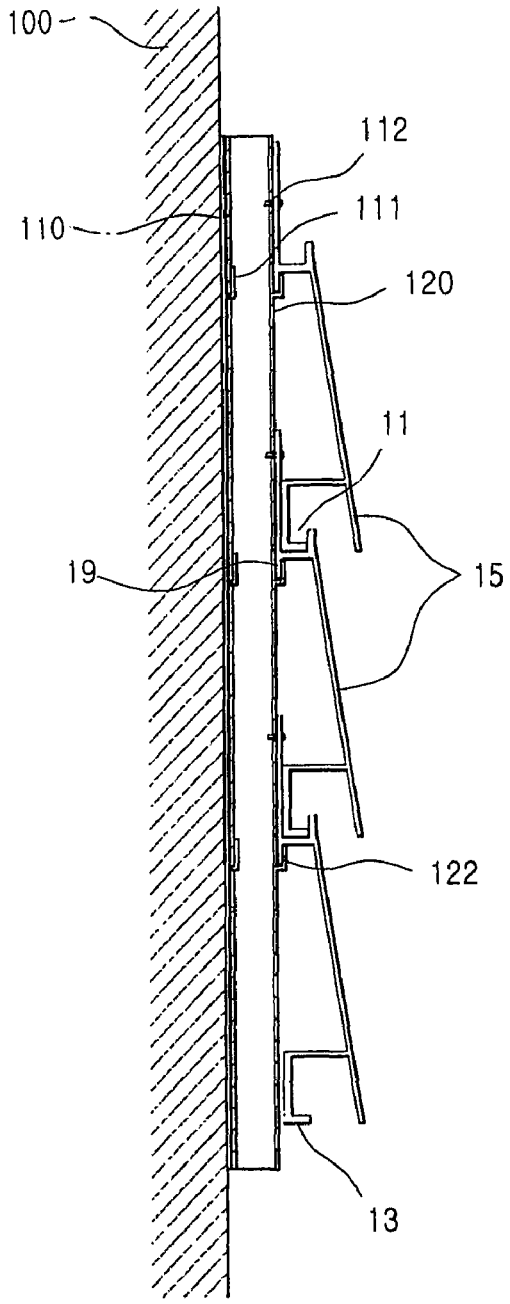
【Fig 13b】
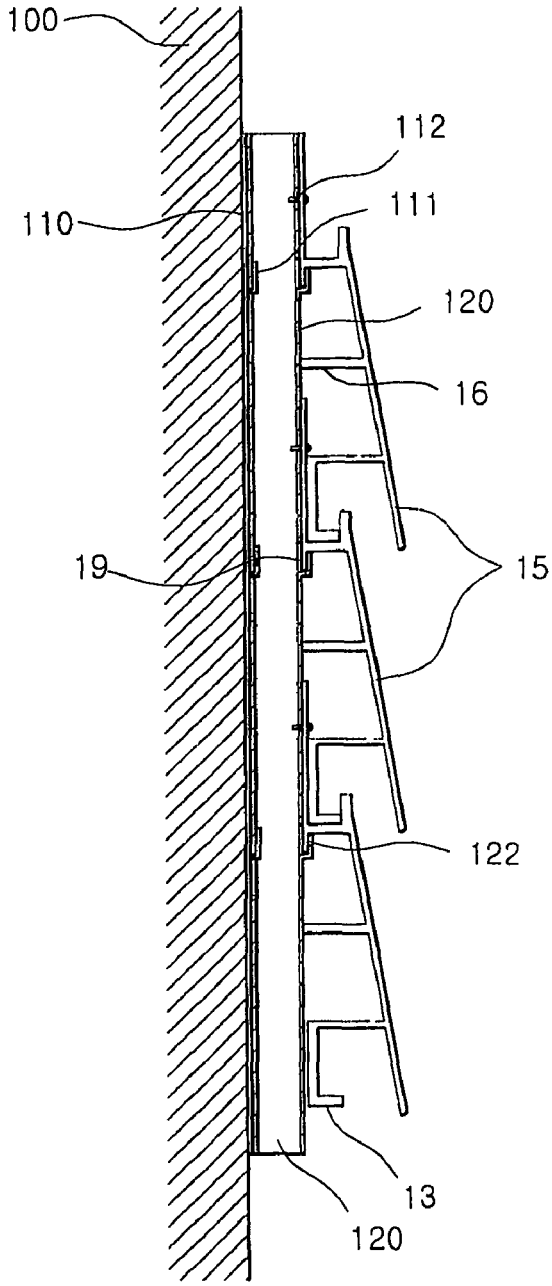

【Fig 13c】
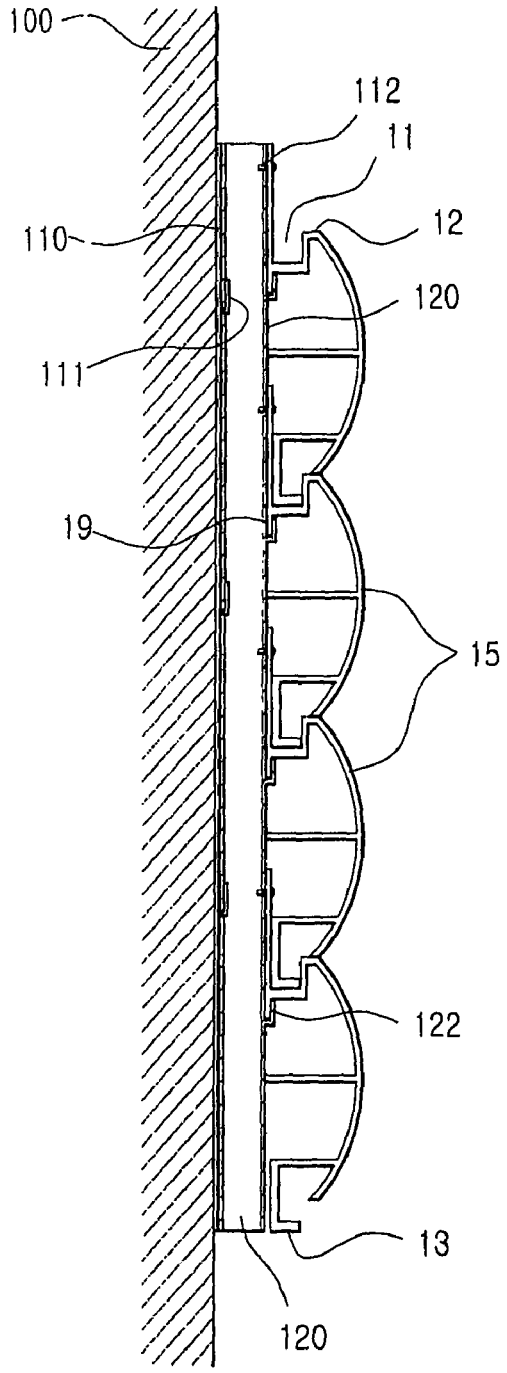
【Fig 13d】
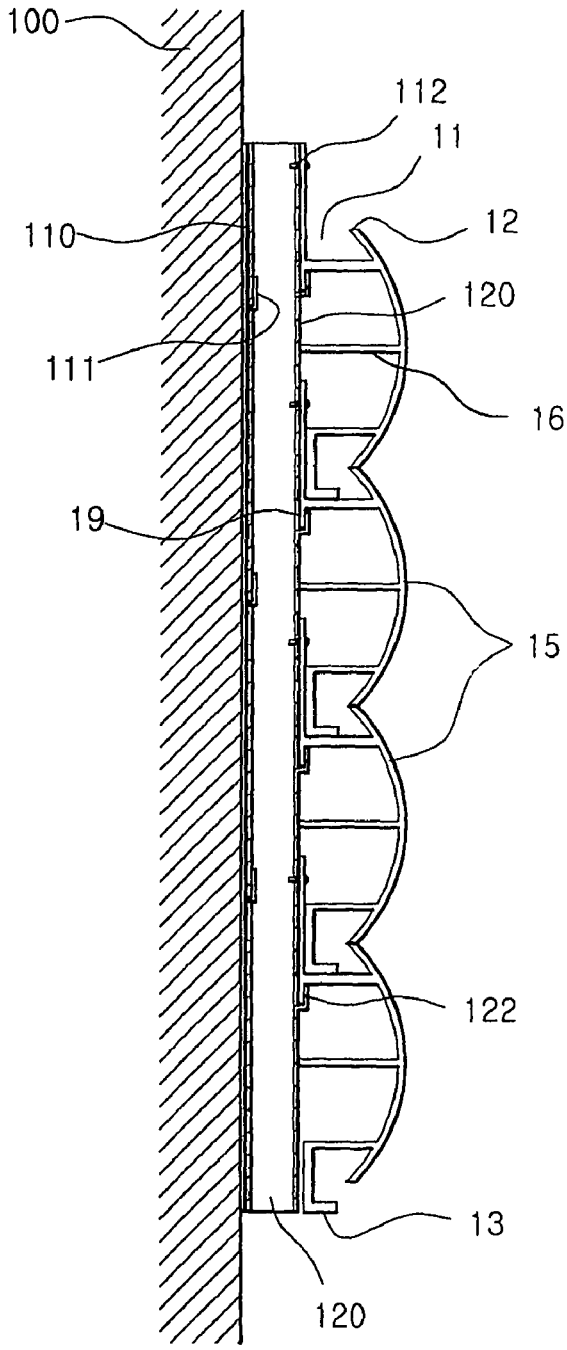

【Fig 13e】
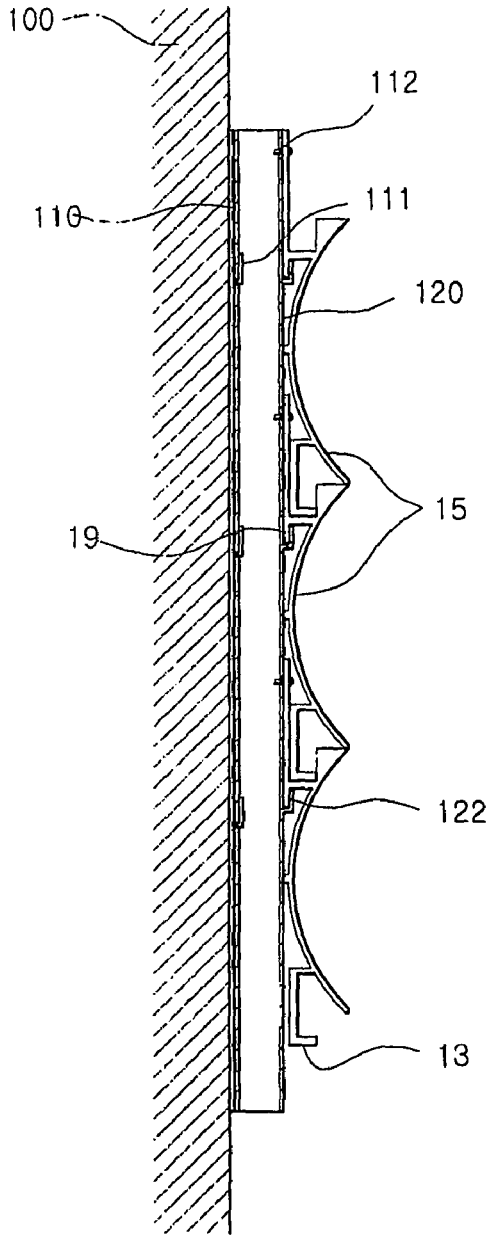
【Fig 13f】
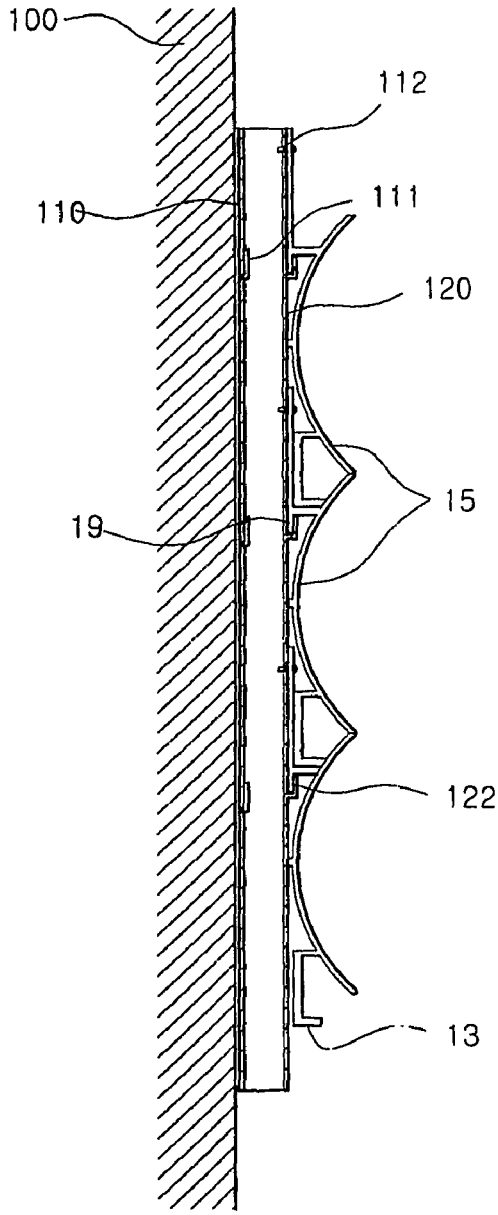

【Fig 13g】
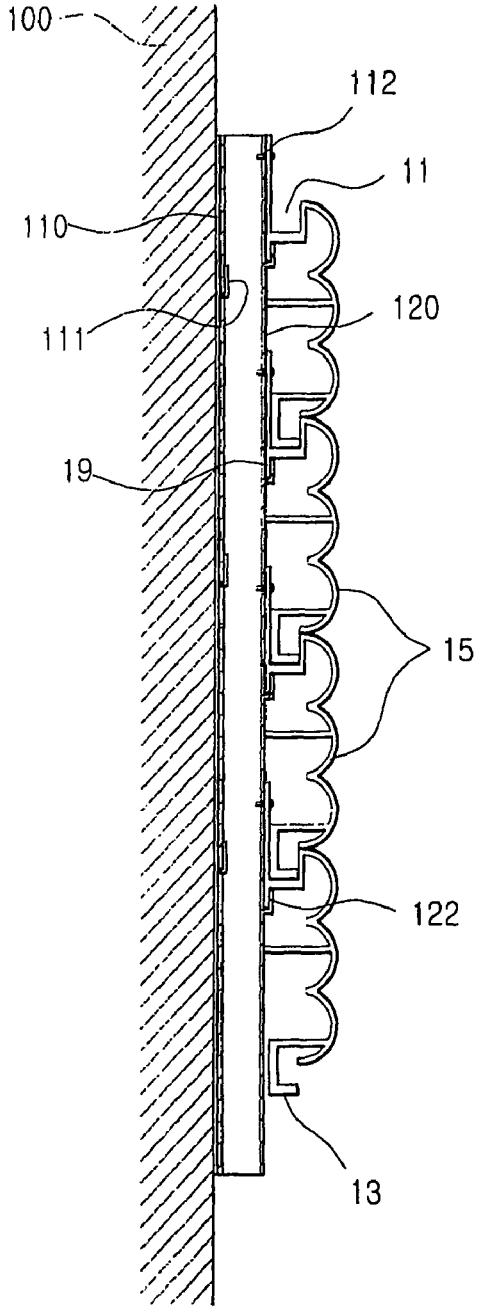
【Fig 13h】
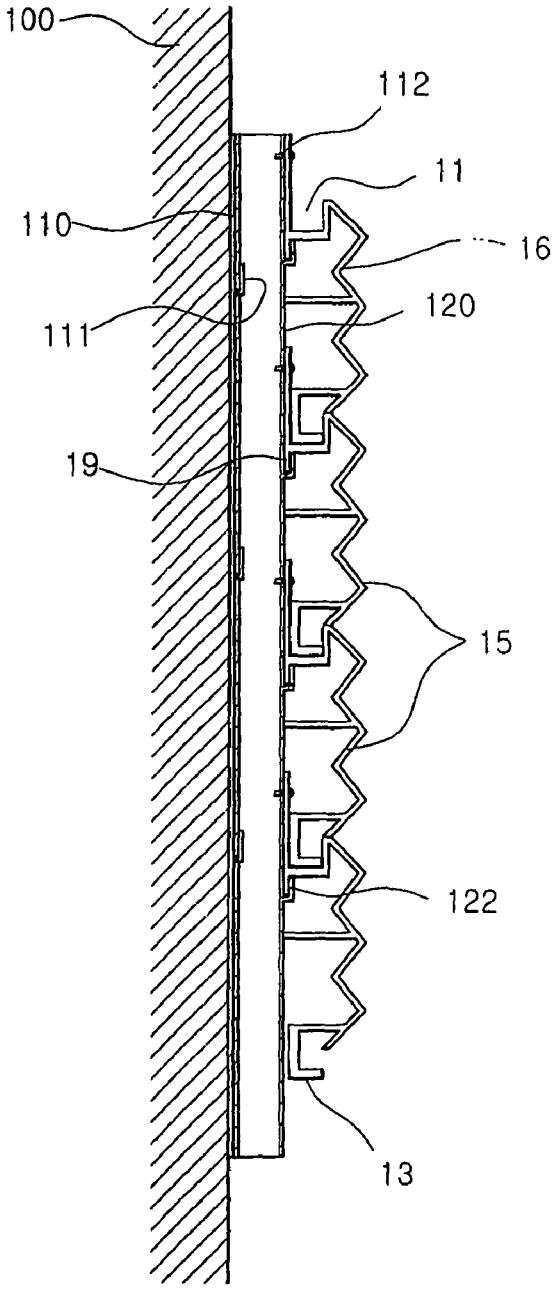

【Fig 13i】
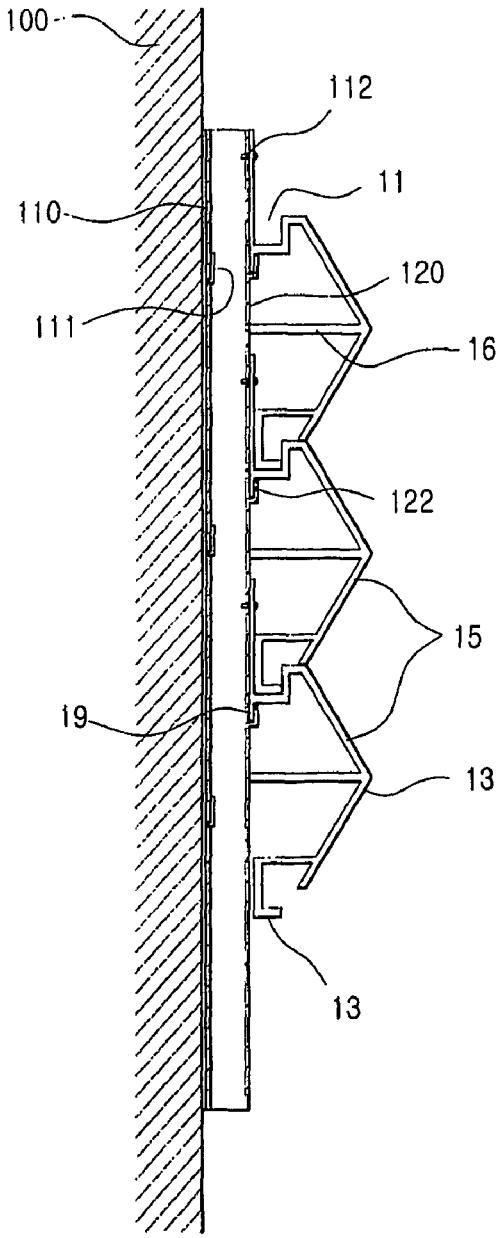
【Fig 13j】
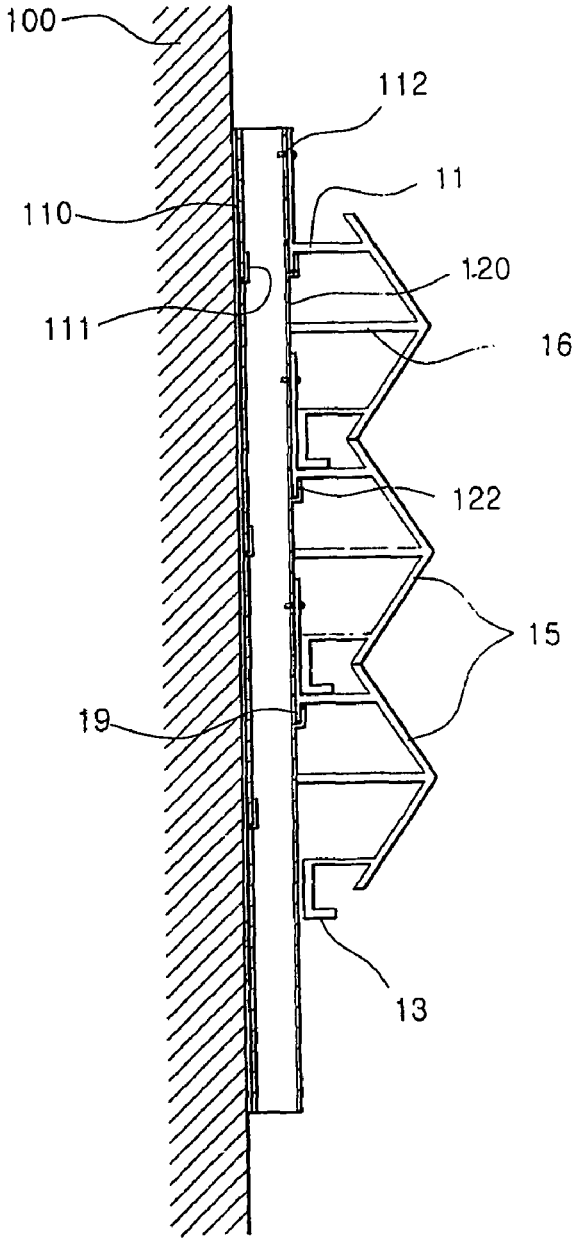

STRUCTURE FOR CONNECTING PREFABRICATED ARCHITECTURAL PANELS

TECHNICAL FIELD

The present invention relates to an assembly of prefabricated panels for interior or exterior walls of a building construction, and more particularly to an assembly of prefabricated panels for a building construction which is capable of simply achieving connection of prefabricated panels attached to interior or exterior walls of the building construction, and application of a finish to upper, lower and opposite longitudinal ends of each prefabricated panel.

BACKGROUND ART

As building constructions are exposed to weather conditions such as sunlight, rain and snow, and pollution for a prolonged period of time, their exterior walls may be damaged. In order to repair such damage, a remodeling process may be used.

Also, in the interior of a building construction, decorative and functional panels may be attached to the interior walls of the building construction for repair of damage, display of goods, or remodeling of the interior. For such panels, prefabricated panels may be used which are made of bent metal sheets or aluminum sheets.

Such panels, which have an elongated rectangular structure, are fixed to a wall by means of nails or the like in a state of being vertically stacked in an end-to-end abutted manner.

However, since a number of nails must be used upon fixing such panels to a wall in the above mentioned manner, an installation process is prolonged. Furthermore, where this nailing process is applied to an old building construction, it may greatly damage the building construction.

Moreover, the nails used to fix the panels to the wall of such an old building construction provide paths for allowing rainwater to penetrate into the concrete of the building construction, thereby causing the concrete to be rapidly weakened.

Meanwhile, such panels have a limited length and a limited width for convenience of transportation and workability. For this reason, where these panels are attached to a building construction, they must be overlapped with one another while forming longitudinal junctions at certain intervals. Furthermore, these panels have a drawback in that they have no accessory for finishing the corners and upper/lower ends of the building construction.

Another example of panels configured to be used for the above mentioned purpose is disclosed in Korean Utility Model No. 0134667. This utility model discloses insulating panels for roofs. Each insulating panel is formed, at both longitudinal ends thereof, with inner and outer coupling portions, respectively, so that the insulating panels are serially coupled. Each insulating panel is also provided at upper and lower ends thereof with inwardly-bent portions shaped in such a manner that one bent portion has a size to be fitted around the other bent portion, respectively. Accordingly, adjacent insulating panels can be coupled in accordance with a fitted coupling between the bent portions respectively provided at the facing ends thereof. However, since these insulating panels are made of a material other than metal sheets, and the coupling portions thereof have an insufficient rigidity, they may be bent or separated from one another when an external force is applied thereto.

Although the above mentioned structure is applicable to insulating panels, it cannot be applied to non-insulating panels made of, for example, aluminum or other metal sheets. In the latter case, therefore, it is impossible to eliminate drawbacks caused by the fact that the panels have insufficient strength against an external force applied thereto.

DISCLOSURE OF THE INVENTION

The present invention has been made in view of the above mentioned problems involved with conventional cases, and an object of the invention is to provide an assembly of prefabricated panels which includes prefabricated panels respectively having structures for vertically coupling them, panel connecting members for horizontally connecting the prefabricated panels, upper and lower end finishing members, longitudinal end finishing members, and corner finishing members, thereby being capable of providing enhanced convenience and high workability upon the remodeling of a building construction, and preventing penetration of foreign matters such as rainwater and dust, while providing an enhanced decoration effect.

Another object of the invention is to provide an assembly of prefabricated panels which includes strip-shaped first brackets each adapted to be fixed to a building construction wall, and provided with hooks, and second brackets each adapted to be coupled with an associated one of the first brackets, and provided with engagement holes respectively engagable with the hooks, and hooks respectively engagable with prefabricated panels, thereby being capable of easily and firmly attaching the prefabricated panels to the building construction wall, thereby reducing the construction costs, while preventing penetration of foreign matters such as rainwater and dust in accordance with an overlapped arrangement of the prefabricated panels.

In accordance with one aspect, the present invention provides an assembly of prefabricated panels for a building construction comprising: prefabricated panels each having a horizontally-elongated rectangular panel body, an upper bent section formed at an upper end of the panel body to define a coupling recess extending in a longitudinal direction of the panel body while being forwardly opened, an engagement protrusion upwardly protruded from the upper end of the panel body while extending in the longitudinal direction of the panel body, a lower bent section rearwardly bent from a lower end of the panel body while extending in the longitudinal direction of the panel body, the prefabricated panels being vertically aligned while being coupled to one another such a manner that the lower bent section of an upper one of the prefabricated panels vertically adjacent to each other is fitted in the coupling recess of a lower one of the adjacent prefabricated panels; corner finishing members each adapted to finish facing longitudinal ends of the prefabricated panels arranged adjacent to each other at a corner region of the building construction; panel connecting members each adapted to couple facing longitudinal ends of the prefabricated panels longitudinally aligned while being adjacent to each other to define a junction therebetween; longitudinal end finishing members respectively adapted to finish longitudinal ends of the prefabricated panels arranged at an end region of the building construction; upper end finishing members respectively adapted to finish upper ends of uppermost ones of the prefabricated panels; and lower end finishing members respectively adapted to finish lower ends of lowermost ones of the prefabricated panels.

In accordance with another aspect, the present invention provides an assembly of prefabricated panels for a building construction comprising: first brackets adapted to be directly mounted to a wall of the building construction, each of the first brackets having a vertically-extending strip structure, the first bracket having a plurality of hooks arranged in pairs such that the hook pairs thereof are vertically uniformly spaced apart from one another, and bolt holes provided at each of upper and lower end portions in the first bracket; second brackets each adapted to be coupled to an associated one of the first brackets, each of the second brackets having a vertically-extending hollow bar structure, the second bracket having a plurality of engagement holes provided at a rear wall portion of the second bracket while being arranged in pairs such that the hole pairs thereof are vertically uniformly spaced apart from one another, each pair of the engagement holes being adapted to be engaged with an associated pair of the hooks in the associated first bracket, and a plurality of hooks provided at a front wall portion of the second bracket while being vertically uniformly spaced apart from one another; and prefabricated panels each having a panel body, a bent section extending from an upper end of the panel body while being rearwardly and upwardly bent, a first engagement protrusion upwardly protruded from the upper end of the panel body while defining a coupling recess in cooperation with the bent section, and a second engagement protrusion downwardly protruded from a lower end of the bent section, and adapted to be engaged with an associated one of the hooks in each of the second brackets, thereby allowing the prefabricated panels to be supported by the second brackets, and a lower bent section extending from a rear surface of the panel body near a lower end of the panel body while being rearwardly and downwardly bent, the prefabricated panels being vertically aligned while being coupled to one another such a manner that the lower bent section of an upper one of the prefabricated panels vertically adjacent to each other is fitted in the coupling recess of a lower one of the adjacent prefabricated panels.

BRIEF DESCRIPTION OF THE DRAWINGS

The above objects, and other features and advantages of the present invention will become more apparent after a reading of the following detailed description when taken in conjunction with the drawings, in which:

FIG. 1 is a perspective view illustrating prefabricated panels of a panel assembly according to an embodiment of the present invention;

FIG. 2 is a sectional view illustrating an assembled state of prefabricated panels according to another embodiment of the present invention modified from the embodiment of FIG. 1;

FIG. 3 is a sectional view illustrating an application of the panel assembly;

FIG. 4 is a sectional view illustrating another application of the panel assembly;

FIG. 5*a* is a sectional view illustrating a corner finishing member to be used at a region "A" in FIG. 3;

FIG. 5*b* is a sectional view a corner finishing member modified from that of FIG. 5*a;*

FIG. 6 is a sectional view illustrating a panel connecting member to be used at a region "B" in FIG. 3;

FIG. 7 is a sectional view illustrating a longitudinal end finishing member to be used at a region "C" in FIG. 3;

FIG. 8 is a sectional view illustrating an upper end finishing member to be used at a region "D" in FIG. 4;

FIG. 9 is a sectional view illustrating a lower end finishing member to be used at a region "E" in FIG. 4;

FIG. 10*a* is a sectional view illustrating a display panel mounting member coupled with a prefabricated panel in accordance with the present invention;

FIG. 10*b* is a sectional view illustrating a cabinet mounted to a prefabricated panel in accordance with the present invention;

FIG. 11 is an exploded perspective view illustrating an assembly of prefabricated panels according to another embodiment of the present invention;

FIG. 12 is a partially-cut-out assembled perspective view illustrating an assembly of prefabricated panels according to another embodiment of the present invention modified from the embodiment of FIG. 12; and FIGS. 13*a* to 13*j* are sectional views illustrating use of various panel assemblies including the panel assembly shown in FIG. 11 or other panel assemblies in which their prefabricated panels are modified from those of FIG. 11 to have various panel body shapes, respectively.

BEST MODE FOR CARRYING OUT THE INVENTION

Now, the present invention will be described in detail, in conjunction with configurations according to respective embodiments thereof.

FIG. 1 is a perspective view illustrating prefabricated panels of a panel assembly according to an embodiment of the present invention. FIG. 2 is a sectional view illustrating an assembled state of prefabricated panels according to another embodiment of the present invention modified from the embodiment of FIG. 1.

As shown in FIGS. 1 and 2, each prefabricated panel denoted by the reference numeral 10 has a horizontally-elongated rectangular panel body 15, an upper bent section formed at an upper end of the panel body 15 to define a coupling recess 11 extending in a longitudinal direction of the panel body 15 while being forwardly opened, and an engagement protrusion 12 upwardly protruded from the upper end of the panel body 15 into the coupling recess 11 by a desired length while extending in the longitudinal direction of the panel body 15. The prefabricated panel 10 also has a lower bent section 13 rearwardly bent from a lower end of the panel body 15 while extending in the longitudinal direction of the panel body 15. The lower bent section 13 has a size to be fittable in the coupling recess 11. In accordance with this structure, each panel 10 can be coupled with another panel denoted by the reference numeral 10-1 and drawn by a phantom line in FIG. 1 by fitting the lower bent section 13 thereof in the coupling recess, denoted by the reference numeral 11-1, of the panel 10-1.

Where the panel body 15 is large, the prefabricated panel 10 may also have at least one reinforcing section 16 rearwardly protruded from a rear surface of the panel body 15 while extending in the longitudinal direction of the panel body 15 in order to reinforce the panel body 15. Only one reinforcing section 16 is provided in the embodiment illustrated in FIG. 1, whereas a plurality of reinforcing sections 16 are provided in the embodiment illustrated in FIG. 2.

FIG. 5*a* is a sectional view illustrating a corner finishing member. This corner finishing member is adapted to finish a corner region defined when the prefabricated panels 10 are attached to a building construction, as indicated by a region "A" in FIG. 3. As shown in FIG. 5*a*, the corner finishing member denoted by the reference numeral 20 has a diagonal body portion, a pair of outer extensions 21 extending outwardly from opposite ends of the diagonal body portion in horizontal and vertical directions, respectively, a pair of inner extensions 22 extending inwardly from the opposite ends of the diagonal body portion in vertical and horizontal directions, respectively, and a pair of outer claws 23 protruded outwardly from the inner extensions 22, respectively. The corner finishing member 20 is coupled with the facing longitudinal ends of prefabricated panels 10 defining a corner region therebetween, by fitting the facing ends of the prefabricated panels 10 between the outer extensions 21 and the associated outer claws 23, respectively. FIG. 5*b* illustrates a corner finishing member having a structure in which the outer extensions 21 are eliminated from the corner finishing member of FIG. 5*a*. Although the outer extensions 21 are eliminated, this structure can support the prefabricated panels 10 by the outer claws 23 and the apexes of the inner protrusions 22.

FIG. 6 is a sectional view illustrating a panel connecting member. This panel connecting member is adapted to couple the facing longitudinal ends of two prefabricated panels, that is, the prefabricated panels 10 and 10-2, arranged adjacent to each other while forming a junction therebetween, as indicated by a region "B" in FIG. 3. As shown in FIG. 6, the panel connecting member denoted by the reference numeral 30 has a T-shaped body 31 having a horizontal portion and a vertical portion extending vertically, at one end thereof, from a central position of the horizontal portion, and a pair of coupling claws 32 extending inclinedly outwardly from the other end of the vertical portion in the T-shaped body 31 toward the horizontal portion of the T-shaped body 31 at opposite sides of the vertical portion, respectively. The panel connecting member 30 is coupled with the facing ends of the prefabricated panels 10 and 10-2 by fitting the facing ends of the prefabricated panels 10 and 10-2 between the horizontal portion of the T-shaped body 31 and the associated coupling claws 32, respectively.

FIG. 7 is a sectional view illustrating a longitudinal end finishing member. This longitudinal end finishing member is adapted to finish the longitudinal end of a prefabricated panel 10 exposed at an end region without facing any other prefabricated panel, as indicated by a region "C" in FIG. 3. As shown in FIG. 7, the longitudinal end finishing member denoted by the reference numeral 40 has an inverted L-shaped body 41 having a horizontal portion and a vertical portion, and a coupling claw 42 extending inclinedly from a substantially intermediate position of the vertical portion in the inverted L-shaped body 41 toward the horizontal portion of the inverted L-shaped body 41. The longitudinal end finishing member 40 is fitted around the longitudinal end of the prefabricated panel 10 exposed at the end region.

FIG. 8 is a sectional view illustrating an upper end finishing member. This upper end finishing member is adapted to finish the upper end of an uppermost one of the prefabricated panels 10 attached to the building construction, as indicated by a region "D" in FIG. 4. As shown in FIG. 8, the upper end finishing member denoted by the reference numeral 50 has an S-shaped body having upper and lower bent portions 51 and 13-1, and a coupling claw 52 extending inclinedly inwardly from an outer tip of the upper bent portion 51. The upper end finishing member 50 is coupled with the upper end of the uppermost prefabricated panel 10 by engaging the coupling claw 52 with the rear surface of the uppermost prefabricated panel 10 at the upper end of the uppermost prefabricated panel 10 while fitting the lower bent portion 13-1 in the fitting recess 11 of the uppermost prefabricated panel 10.

FIG. 9 is a sectional view illustrating a lower end finishing member. This lower end finishing member is adapted to finish the lower end of a lowermost one of the prefabricated panels 10 attached to the building construction, as indicated by a region "E" in FIG. 4. As shown in FIG. 9, the lower end finishing member denoted by the reference numeral 60 has an inverted S-shaped body 15-1 having an upper bent portion defining a forwardly-opened coupling recess 11-1, and an engagement protrusion 12-1 upwardly protruded from the upper end of the inverted S-shaped body 15-1 into the coupling recess 11-1 by a desired length. The lower end of the lower end finishing member 60 is rearwardly bent. The lower end finishing member 60 is coupled with the lower end of the lowermost prefabricated panel 10 by fitting the lower bent section 13 of the lowermost prefabricated panel 10 in the coupling recess 11-1.

The prefabricated panels of the present invention are usable not only for the exterior walls of a building construction, but also for the interior walls of the building construction. In particular, where the prefabricated panels are used for the interior walls of the building construction, a display panel mounting member 70 may be coupled with the coupling recess 11 of a selected one of the prefabricated panels in order to mount a display panel 71 for goods to the selected prefabricated panel, as shown in FIG. 10*a* which is a sectional view illustrating the display panel mounting member coupled to the prefabricated panel.

As shown in FIG. 10*a*, the display panel mounting member 70 has a hook 72 adapted to be engaged with the engagement protrusion 12 of the prefabricated panel 10 to be coupled with the display panel mounting member 70, a fitting portion 73 for fitting an end of the display panel 71 therein, and a support portion 74 for supporting the end of the display panel 71 fitted in the fitting portion 73. In accordance with this structure, the display panel mounting member 70 can mount the display panel 71 to the prefabricated panel 10 in order to display goods on the display panel 71.

Meanwhile, cabinets or various hangers may be attached to the prefabricated panels 10 using hook members each adapted to be mounted to a cabinet or hanger while being engaged with the engagement protrusion 12 of a selected prefabricated panel 10. FIG. 10*b* illustrates an example in which a cabinet 80 is mounted to a selected prefabricated panel 10.

FIG. 11 is an exploded perspective view illustrating an assembly of prefabricated panels according to another embodiment of the present invention. FIG. 12 is a partially-cut-out assembled perspective view illustrating an assembly of prefabricated panels according to another embodiment of the present invention modified from the embodiment of FIG. 12. FIGS. 13*a* to 13*j* are sectional views illustrating use of various panel assemblies including the panel assembly shown in FIG. 11 or other panel assemblies in which their prefabricated panels are modified from those of FIG. 11 to have various panel body shapes, respectively.

Basically, each of the panel assemblies shown in FIGS. 11, 12, and 13*a* to 13*j* includes first brackets 110 adapted to be directly mounted to a wall 100 of the building construction. Each first bracket 110 has a vertically-extending strip structure while being provided with a plurality of hooks 111 arranged in pairs such that the hook pairs are vertically uniformly spaced apart from one another, Bolt holes 112 are also provided at each of the upper and lower end portions in each first bracket 110. The panel assembly also includes second brackets 120 each adapted to be coupled to an associated one of the first brackets 110. Each second bracket 120 has a vertically-extending hollow bar structure while being provided, at a rear wall portion thereof, with a plurality of engagement holes 121 arranged in pairs such that the hole pairs are vertically uniformly spaced apart from one another. Each pair of the engagement holes 121 is adapted to be engaged with an associated pair of the hooks 111 in the associated first bracket 110. Each second bracket 120 is also provided, at a front wall portion thereof, with a plurality of hooks 122 vertically uniformly spaced apart from one another. Each of the prefabricated panels, which are included in the panel assembly, has a panel body 15, an upper bent section extending from an upper end of the panel body 15 while being rearwardly and upwardly bent, a first engagement protrusion 12 upwardly protruded from the upper end of the panel body 15 while defining a coupling recess 11 in cooperation with the upper bent section, and a second engagement protrusion 19 downwardly protruded from the lower end of the bent section, and adapted to be engaged with an associated one of the hooks 122 in the second bracket 120. Each prefabricated panel also has a lower bent section 13 extending from a rear surface of the panel body 15 near a lower end of the panel body 15 while being rearwardly and downwardly bent. The prefabricated panels are vertically aligned while being coupled to one another such a manner that the lower bent section 13 of the upper prefabricated panel 10 is fitted in the coupling recess 11 of the lower prefabricated panel 10-1, as shown in FIG. 11. The second bracket 120 may be dispensed with. In this case, the second engagement protrusion 19 is engaged with an associated pair of the hooks 111 in the first bracket 110.

In the drawings, the reference numeral 80 denotes a cabinet, 100 a building wall, 101 an intermediate bracket, and 102 nails.

Now, the procedure for assembling the constituting elements of the panel assembly according to each embodiment of the present invention will be described in detail with reference to the drawings.

FIG. 2 is a sectional view illustrating an assembled state of the prefabricated panels included in the panel assembly according to one embodiment of the present invention. FIG. 3 is a sectional view illustrating an application of the panel assembly. FIG. 4 is a sectional view illustrating another application of the panel assembly.

The panel assembly of the present invention may be used when it is desired to remodel an old building construction for protection and repair of the building construction, by attaching the prefabricated panels 10 of the panel assembly to an exterior wall of the building construction in a state of being vertically stacked along the exterior wall in an end-to-end abutted manner.

That is, one prefabricated panel 10 is first attached to a lower end portion of the exterior wall, and then nailed on the lower wall end portion at its coupling recess 11, so that it is firmly fixed to the exterior wall, as shown in FIG. 2. Although the prefabricated panel 10 is nailed to an intermediate bracket 101 in the case of FIG. 2, it will be described as being nailed to the exterior wall of the building construction in the following description for convenience.

Thereafter, another prefabricated panel 10 is stacked on the fixed, lower prefabricated panel 10 in an end-to-end abutted manner. At this time, the coupling of the upper and lower prefabricated panels 10 can be achieved by inserting the lower bent section 13 of the upper prefabricated panel 10 into the coupling recess 11 of the lower prefabricated panel 10, and then downwardly pushing the lower bent section 13 along the coupling recess 11 until the lower end of the lower bent section 13 comes into contact with the bottom of the coupling recess 11. In this state, the lower bent section 13 of the upper prefabricated panel 10 is firmly fitted in the coupling recess 11 of the lower prefabricated panel 10 in a state of being engaged, at its lower end, with the engagement protrusion 12 of the upper prefabricated panel 10.

In such a manner, a plurality of prefabricated panels can be vertically assembled to cover the entire wall portion of the building construction.

However, the prefabricated panels have a limited length for convenience of manufacture, transportation, storage, and workability. For this reason, they must also be longitudinally assembled to cover the entire wall portion of the building construction. In this case, the longitudinally-adjacent prefabricated panels, for example, the prefabricated panels 10 and 10-2, are connected by the panel connecting member 30 of FIG. 6.

The panel connecting member 30, which has a T-shaped structure as shown in FIG. 6, is interposed between the facing longitudinal ends of the longitudinally-adjacent prefabricated panels 10 and 10-2, and coupled with the facing longitudinal ends of the prefabricated panels 10 and 10-2 by forcibly fitting the facing longitudinal ends of the prefabricated panels 10 and 10-2 between the horizontal portion of the T-shaped body 31 and the associated coupling claws 32, respectively, while covering a junction of the facing longitudinal ends by the horizontal portion of the T-shaped body 31.

Accordingly, it is possible to prevent foreign matters such as rainwater or dust from penetrating into the junction while providing a satisfactory decorative finish.

On the other hand, the corner finishing member 20 shown in FIG. 5*a* or 5*b* is used at a corner where the front and side wall portions of the building construction are connected.

That is, in the case of FIG. 5*a*, the corner finishing member 20 is coupled with the facing longitudinal ends of prefabricated panels 10 defining a corner region therebetween, by forcibly fitting the facing longitudinal ends of the prefabricated panels 10 between the outer extensions 21 and the associated outer claws 23, respectively, while covering a space defined between the facing longitudinal ends. Accordingly, it is possible to prevent foreign matters from penetrating into the junction while providing a satisfactory decorative finish. In the case of FIG. 5*b* in which the outer extensions 21 are dispensed with, the prefabricated panels 10 may be supported by the outer claws 23 and the apexes of the inner protrusions 22.

Where it is desired to finish the longitudinal end of a prefabricated panel 10 exposed at an end region, the longitudinal end finishing member 40 of FIG. 7 having an inverted L-shaped structure is used. The longitudinal end finishing member 40 is coupled with the longitudinal end of the prefabricated panel 10 exposed at the end region by fitting the longitudinal end of the prefabricated panel 10 between the horizontal portion of the L-shaped body 41 and the coupling claw 42. Accordingly, the longitudinal end of the prefabricated panel 10 is covered by the longitudinal end finishing member 40.

Where it is desired to finish the upper end of an uppermost one of the prefabricated panels 10 attached to the building construction, the upper end finishing member of FIG. 8 having an S-shaped structure is used. The upper end finishing member 50 is coupled with the upper end of the uppermost prefabricated panel 10 by fitting the lower bent portion 13-1 in the fitting recess 11 of the uppermost prefabricated panel 10 while engaging the coupling claw 52 with the rear surface of the uppermost prefabricated panel 10 at the upper end of the uppermost prefabricated panel 10.

Accordingly, the upper end of the prefabricated panel 10 is covered by the longitudinal end finishing member 40, so that it is smartly finished.

Where the lower end portion of a building construction wall is to be finished, it is desirable to first attach the lower end finishing member 60 of FIG. 9 to the lower wall end portion.

That is, the lower end finishing member 60 is first fixed to the lower end portion of the building construction wall at the coupling recess 11-1 thereof by means of nails. Thereafter, the lower bent section 13 of a prefabricated panel 10 is fitted in the coupling recess 11-1 of the lower end finishing member 60. Thus, the prefabricated panel 10 is coupled to the lower end finishing member 60. Since the lower end finishing member 60 has a small width, it maintains a sufficient firmness by the fixing means. Also, the lower end finishing member 60 provides a decorative finish because it covers the lower end portion of the building construction wall by its body 15-1.

The prefabricated panels of the present invention are usable not only for the exterior walls of a building construction, but also for the interior walls of the building construction. In particular, where the prefabricated panels are used for the interior walls of the building construction, the display panel mounting member 70 may be coupled with the coupling recess 11 of a selected one of the prefabricated panels in order to mount a display panel for goods or a decorative cabinet to the selected prefabricated panel.

As described above, the display panel mounting member 70 has the hook 72 adapted to be engaged with the engagement protrusion 12 of the prefabricated panel 10 to be coupled with the display panel mounting member 70, the fitting portion 73 for fitting an end of the display panel 71 therein, and the support portion 74 for supporting the end of the display panel 71 fitted in the fitting portion 73. In accordance with this structure, the display panel mounting member 70 can be conveniently used in that it can be coupled to and separated from the prefabricated panel 10 by simply engaging the hook 72 with the engagement protrusion 12 and simply disengaging the hook 72 from the engagement protrusion 12. Also, the display panel mounting member 70 can provide an enhanced display effect for goods in that it can support a wide display panel.

The panel assembly of FIG. 11 or 12 may also be used. As described above, FIG. 11 is an exploded perspective view illustrating an assembly of prefabricated panels according to the embodiment of the present invention different from that of FIG. 1. FIG. 12 is a partially-cut-out assembled perspective view illustrating the assembly of prefabricated panels according to the embodiment of the present invention modified from the embodiment of FIG. 12. In either case of FIG. 11 or 12, each first bracket 110 is first mounted to the wall 100 of the building construction by means of the bolt holes 112 provided at each of the upper and lower end portions in the first bracket 110. As described above, the first bracket 110 has the hooks 111 arranged in pairs such that the hook pairs are vertically uniformly spaced apart from one another. Each second bracket 120 is then coupled to the associated first bracket 110 by engaging each pair of its engagement holes 121 with an associated pair of the hooks 111 in the associated first bracket 110. As described above, each second bracket 120 is provided, at the front wall portion thereof, with the hooks 122 vertically uniformly spaced apart from one another.

Prefabricated panels are coupled to respective hooks 122 of the second bracket 120. Each prefabricated panel may have the panel body 15, the upwardly-protruded first engagement protrusion 12 upwardly protruded from the upper end of the panel body 15, and the downwardly-protruded second engagement protrusion 19. The second engagement protrusion 19 of the prefabricated panel is engaged with an associated one of the hooks 122 in the second bracket 120. In such a manner, the prefabricated panels are sequentially coupled to the second bracket 120 so that they are vertically aligned. Thus, the prefabricated panels decoratively cover the outer or interior wall of the building construction.

The prefabricated panels can be attached to the building construction wall while being spaced apart from the building wall by a certain distance in accordance with use of both the first bracket 10 and the second bracket 120. Of course, the attachment of the prefabricated panels may be achieved in a state in which the second bracket 120 is dispensed with. In this case, it is possible to minimize the space between each prefabricated panel and the building construction wall.

Thus, it is possible to use both the first bracket and the second bracket or to use a selected one of them.

INDUSTRIAL APPLICABILITY

As apparent from the above description, the present invention provides an assembly of prefabricated panels which includes prefabricated panels respectively having structures for vertically coupling them, panel connecting members for horizontally connecting the prefabricated panels, upper and lower end finishing members, longitudinal end finishing members, and corner finishing members, thereby being capable of providing enhanced convenience and high workability upon the remodeling of a building construction. In accordance with the present invention, it is possible to firmly couple the prefabricated panels and the finishing members, thereby preventing penetration of foreign matters such as rainwater and dust, while providing an enhanced decoration effect. Thus, the present invention can achieve effective remodeling of old building constructions, while providing satisfactory decorative walls on exterior and interior building construction walls. It is also possible to conveniently attach display panels for goods.

The present invention also provides an assembly of prefabricated panels which includes strip-shaped first brackets each adapted to be fixed to a wall by bolts, and provided with hooks, and second brackets each adapted to be coupled with an associated one of the first brackets, and provided with engagement holes respectively engagable with the hooks, and hooks respectively engagable with prefabricated panels. In accordance with this prefabricated panel assembly, it is possible to easily and firmly attach the prefabricated panels to a building construction wall, while preventing penetration of foreign matters such as rainwater and dust.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

The invention claimed is:

1. An assembly of prefabricated panels comprising:

a plurality of prefabricated panels each having:

a front panel body having an upper end and a lower end;

an upper bent section formed toward the upper end of the front panel body, and extending upwardly therefrom to define a coupling recess extending in a longitudinal direction of the panel body, the coupling recess having a bottom flange extending rearward from the front panel body and a rear flange extending upward from a rear end of the bottom flange;

an engagement protrusion upwardly protruded from the upper end of the front panel body, the coupling recess being forwardly opened above the engagement protrusion and extending in the longitudinal direction of the panel body, the engagement protrusion, bottom flange, and rear flange forming a securing receptacle; and a lower bent section rearwardly bent from the lower end of the front panel body while extending in the longitudinal direction of the front panel body, the lower bent section having a rear flange extending downward with respect to the lower end of the front panel body and a bottom flange extending forward from a lower end of the rear flange, the lower bent section of an upper panel of the plurality of prefabricated panels being insertable in the coupling recess of a lower panel of the plurality of prefabricated panels, the rear and bottom flanges of the lower bent section of the upper panel nesting in the securing receptacle of the lower panel, the bottom flange of the lower bent section of the upper panel being positioned contiguous the bottom flange of the coupling recess of the lower panel.

2. The assembly of prefabricated panels according to claim 1, wherein each of the prefabricated panels further has at least one reinforcing section rearwardly protruded from a rear surface of the panel body of the prefabricated panel while extending in the longitudinal direction of the panel body to reinforce the panel body.

3. The assembly of prefabricated panels according to claim 1, further comprising:

corner finishing members each adapted to finish facing longitudinal ends of the prefabricated panels arranged adjacent to each other at a corner region of the assembly wherein each of the corner finishing members has a diagonal body portion, a pair of outer extensions extending outwardly from opposite ends of the diagonal body portion in horizontal and vertical directions, respectively, a pair of inner extensions extending inwardly from the opposite ends of the diagonal body portion in vertical and horizontal directions, respectively, and a pair of outer claws protruded outwardly from the inner extensions, respectively, whereby the corner finishing member is coupled with the facing longitudinal ends of the prefabricated panels in such a manner that the facing longitudinal ends of the prefabricated panels are fitted between the outer extensions and the outer claws associated therewith, respectively.

4. The assembly of prefabricated panels according to claim 1, further comprising:

panel connecting members each adapted to couple facing longitudinal ends of the prefabricated panels longitudinally aligned while being adjacent to each other to define a junction therebetween wherein each of the panel connecting members has a T-shaped body having a horizontal portion and a vertical portion extending vertically, at one end thereof, from a central position of the horizontal portion, and a pair of coupling claws extending inclinedly outwardly from the other end of the vertical portion in the T-shaped body toward the horizontal portion of the T-shaped body at opposite sides of the vertical portion, respectively, whereby the panel connecting member is coupled with the facing longitudinal ends of the junction-defining prefabricated panels in such a manner that the facing longitudinal ends of the junction-defining prefabricated panels are fitted between the horizontal portion of the T-shaped body and the coupling claws associated therewith, respectively.

5. The assembly of prefabricated panels according to claim 1, further comprising:

longitudinal end finishing members respectively adapted to finish longitudinal ends of the prefabricated panels arranged at an end region of the assembly wherein each of the longitudinal end finishing members has an inverted L-shaped body having a horizontal portion and a vertical portion, and a coupling claw extending inclinedly from a substantially intermediate position of the vertical portion in the inverted L-shaped body toward the horizontal portion of the inverted L-shaped body, whereby the longitudinal end finishing member is coupled to the longitudinal end of the prefabricated panel associated therewith in such a manner that the longitudinal end of the associated prefabricated panel is fitted between the horizontal portion of the inverted L-shaped body and the coupling claw associated therewith.

6. The assembly of prefabricated panels according to claim 1, further comprising:

upper end finishing members respectively adapted to finish upper ends of uppermost ones of the prefabricated panels wherein each of the upper end finishing members has an S-shaped body having upper and lower bent portions, and a coupling claw extending inclinedly inwardly from an outer tip of the upper bent portion, whereby the upper end finishing member is coupled with the upper end of the uppermost prefabricated panel associated therewith in such a manner that the coupling claw of the upper end finishing member is engaged with a rear surface of the associated uppermost prefabricated panel at the upper end of the associated uppermost prefabricated panel, and that the lower bent portion is fitted in the coupling recess of the associated uppermost prefabricated panel.

7. The assembly of prefabricated panels according to claim 1, further comprising:

lower end finishing members respectively adapted to finish lower ends of lowermost ones of the prefabricated panels wherein each of the lower end finishing members has an inverted S-shaped body having an upper bent portion defining a forwardly-opened coupling recess, and an engagement protrusion upwardly protruded from an upper end of the inverted S-shaped body, whereby the lower end finishing member is coupled with the lower end of the associated lowermost prefabricated panel in such a manner that the lower bent section of the associated lowermost prefabricated panel is fitted in the coupling recess of the lower end finishing member.

8. The assembly of prefabricated panels according to claim 1, further comprising:

display panel mounting members each coupled with the coupling recess of a selected one of the prefabricated panels, and adapted to mount a display panel for goods to the selected prefabricated panel, each of the display panel mounting members having a hook adapted to be engaged with the engagement protrusion of the prefabricated panel to be coupled with the display panel mounting member, a fitting portion for fitting an end of the display panel therein, and a support portion for supporting the end of the display panel fitted in the fitting portion.

9. The assembly of prefabricated panels according to claim 1 wherein the front panel body of at least one of the plurality of prefabricated panels is planar.

* * * * *